US007600400B2

(12) United States Patent
Lonati

(10) Patent No.: US 7,600,400 B2
(45) Date of Patent: Oct. 13, 2009

(54) TENSIONING DEVICE FOR CIRCULAR KNITTING MACHINES

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 12/093,678

(22) PCT Filed: Oct. 27, 2006

(86) PCT No.: PCT/IT2006/000759

§ 371 (c)(1),
(2), (4) Date: Jun. 23, 2008

(87) PCT Pub. No.: WO2007/057935

PCT Pub. Date: May 24, 2007

(65) Prior Publication Data

US 2008/0283648 A1 Nov. 20, 2008

(30) Foreign Application Priority Data

Nov. 18, 2005 (IT) ..... BS2005A0140

(51) Int. Cl.
*D04B 15/88* (2006.01)

(52) U.S. Cl. ..... 66/151; 66/153

(58) Field of Classification Search ..... 66/152, 66/149 R, 147, 150, 151
See application file for complete search history.

(56) References Cited

U.S. PATENT DOCUMENTS

| | | | | |
|---|---|---|---|---|
| 3,718,300 | A * | 2/1973 | Aronoff | 242/533.1 |
| 4,314,462 | A * | 2/1982 | Ducol et al. | 66/152 |
| 5,317,885 | A * | 6/1994 | Vignoni | 66/151 |
| 5,566,558 | A | 10/1996 | Tsuchiya | |
| 6,029,478 | A | 2/2000 | Panuccio | |
| 6,601,412 | B1 * | 8/2003 | Quay et al. | 66/152 |
| 2005/0229642 | A1 | 10/2005 | Lonati | |

FOREIGN PATENT DOCUMENTS

| | | |
|---|---|---|
| EP | 456576 | 11/1991 |
| EP | 0696658 A | 2/1996 |
| EP | 0893527 A | 1/1999 |
| EP | 1155176 | 11/2001 |
| EP | 1335056 A1 | 8/2003 |
| WO | WO 00/50678 | 8/2000 |
| WO | WO2005100659 A | 10/2005 |

* cited by examiner

*Primary Examiner*—Danny Worrell
(74) *Attorney, Agent, or Firm*—Pearne & Gordon LLP

(57) ABSTRACT

A tensioning device (1) for circular knitting machines (3) comprising a supporting frame (2) to be mounted turnably below a circular knitting machine (3), a cutter (9) associated to the supporting frame (2) and designed to cut a knitted fabric in tubular piece (5) produced by the circular knitting machine (3), an opener and stretcher (11) for opening and stretching the cut piece (5) in a single fabric layer, a collector (16) for collecting the piece (5) stretched in a single layer by said opener and stretcher (11), and a tensioner (12) for tensioning the piece (5) of knitted fabric, designed to tension the piece (5) of fabric so as to enable the correct production of the piece (5) of fabric by the knitting machine (3), which a tensioner (12) is arranged upstream from the opener and stretcher (11).

29 Claims, 3 Drawing Sheets

TENSIONING DEVICE FOR CIRCULAR KNITTING MACHINES

The present invention relates to a tensioning device for circular knitting machines.

In particular, the device is of "OPEN"-type and enables the automatic and progressive cutting of the piece of tubular knitted fabric manufactured by the knitting machine, the spreading of the piece of knitted fabric and of its side welds obtained by stretching and cutting a single layer of fabric of the spread piece, and the collection of said piece, either in rolls or laps depending on the various cases. The device comprises a turnable supporting frame placed below the circular knitting machine, a piece-spreading element enabling to suitably shape the tubular piece of fabric during its forward movement, a cutter placed downstream from the piece-spreading elements and designed to cut the tubular piece longitudinally along a generatrix, means for opening and stretching the cut piece in a single fabric layer, a fabric tensioning assembly and an assembly for collecting the piece stretched in a single layer.

It is known that in large-diameter "OPEN"-type machines, the fabric is neither collected nor tensioned directly in a tubular shape, so as to prevent the formation of permanent folds on the fabric, and therefore, the tubular fabric is opened by means of one longitudinal cut before being tensioned, so as to be able to stretch the piece of fabric in one layer whose width corresponds to the whole fabric circumference.

Collecting devices of this type are disclosed for instance in European patents no. EP456576 or no. EP1155176, wherein the device is equipped with a supporting frame arranged below the circular knitting machine and turning integrally with the cylinder thereof. It is further known about a collecting device that can be actuated in rotation at a different angular speed from the one of the cylinder, as disclosed in application WO2005100659, wherein the fabric also undergoes a twist during the collecting step, which twist is designed to counterbalance fabric deformations due to the use of twisted yarns.

The content of the patents mentioned above as far as the fabric collecting device are to be understood as being herein incorporated by reference.

Such systems are provided with means designed to suitably shape the tubular piece coming from the circular machine, with a cutter designed to cut the tubular piece longitudinally along a generatrix, and with means for opening and stretching the cut piece in one fabric layer. In all known devices, the supporting frame is associated with a tensioner made up of one or more groups of traction rollers for feeding the piece in a controlled manner in the various portions of the collecting device, arranged between the fabric opening and stretching means and the fabric collecting means.

The prior art as briefly described above has huge drawbacks. It should be pointed out that fabric tensioning in knitting machines further has important textile functions, since it affects directly fabric manufacturing and it is therefore fundamental that it is regulated very accurately for enabling an optimal and high-quality fabric production. Moreover, tensioning also enables to push the fabric inside the collecting device, and thus, beyond providing a continuous tensioning force onto the fabric being manufactured, it should also overcome the mechanical resistances of the various parts of the collecting device, such as the piece-spreading device, the opening and stretching means and the large number of return and stretching rollers that are usually present. Conventional tensioning systems do not allow to regulate the tensioning force acting upon the fabric being manufactured in a very accurate way, since they are affected by the frictions of the various mechanical parts of the collecting device. Therefore, since such frictions can have an influence that is hardly predictable and changing with time in a little controllable way, tensioning on the fabric being manufactured is always a little inaccurate, with negative effects on the quality of the fabric, which can be of a lower quality due to an excessive tensioning, to too low a tensioning or to a non-uniform tensioning in time, which deforms. the knitted structure itself. Moreover, conventional tensioning means should be oversized exactly for counterbalancing the influences of the remaining mechanical parts of the collecting device, and are therefore always quite bulky and expensive. Eventually, it should be pointed out that in the case of a collecting device turning at a different speed from cylinder speed, as in application WO2005100659 mentioned above, the fabric further undergoes a twist increasing piece frictions with the mechanical portions, and it is therefore possible that, in case of high speed differences, known tensioning systems cannot prevent fabric twisting. It is also known from document EP 1.335.056 a piece-pulling device comprising a pair of diverter rollers which are motorized and exert a tractive force on the fabric and have axes parallel to and side by side with each other. The diverter rollers are associated with a cutting device which cuts the tubular fabric produced by the circular machine along a longitudinal cutting line. Downstream of the cutting device are an underlying pair of divaricating rods which open the fabric and lay it flat and underneath said rods, a series of traction and guide rollers, at least one of which is motorized, to pull the fabric and wind it on a piece-winding roller. It is further known from document EP 696.658 a circular knitting machine and take-up mechanism therefor including a knitting unit for forming a tubular knit fabric, a first set of let-off rolls for flattening the tubular fabric into a double-layer web and delivering the web from the knitting unit, a slitter for slitting the flattened tubular fabric longitudinally along a predetermined line, a spreader for spreading the slit fabric into a single layer web, the spreader being extendable and contractible to spread fabrics of varying widths, a second set of let-off rolls for drawing the fabric across the spreader and a fabric take-up for taking-up the single layer web for storage and subsequent use. Under these circumstances, the technical task underlying the present invention is to provide a tensioning device for circular knitting machines that is able to basically obviate the drawbacks referred to. In the framework of this technical task, an important aim of the invention is to provide a tensioning device for circular knitting machines that enables to obtain a very accurate and time-constant tensioning of the fabric being manufactured, which reduces piece frictions with the mechanical parts.

Another important aim of the invention is to provide a tensioning device for circular knitting machines that enables to have a very reliable fabric tensioning even under the most difficult conditions, in which the device can turn at a different angular speed from the cylinder, preventing any fabric twisting.

A further aim is to provide a tensioning device for circulating machines that has a small size, not too expensive and that is simple to be implemented.

The technical aim and the aims referred to are basically achieved by a tensioning device for circular knitting machines, characterized in that it comprises one or more of the technical solutions claimed below.

The following contains by mere way of indicative and non-limiting example the description of a preferred embodiment of a device according to the invention, as shown in the accompanying drawings, wherein.

Figure 1:
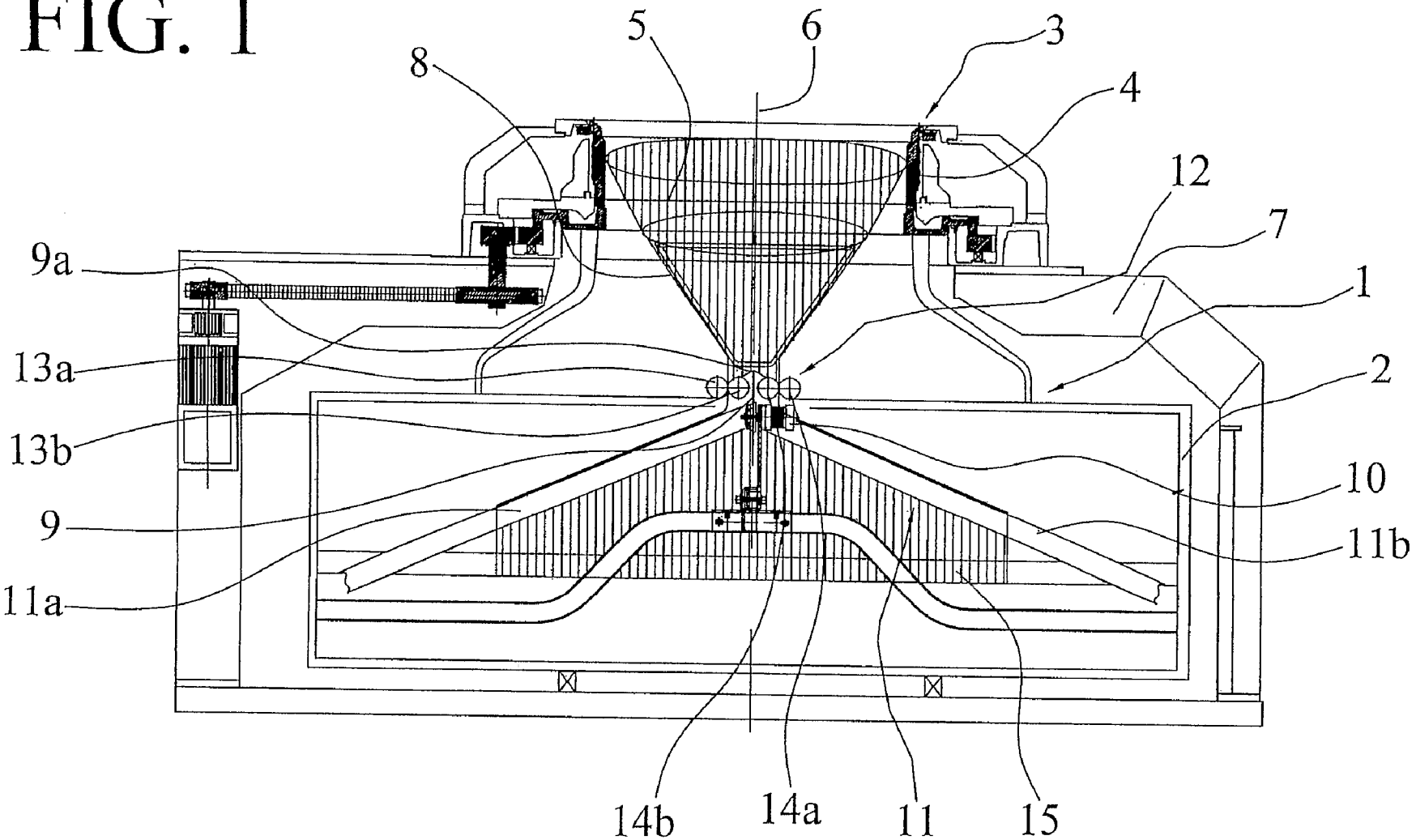
FIG. 1 shows a view in lateral elevation of the device.
Figure 2:
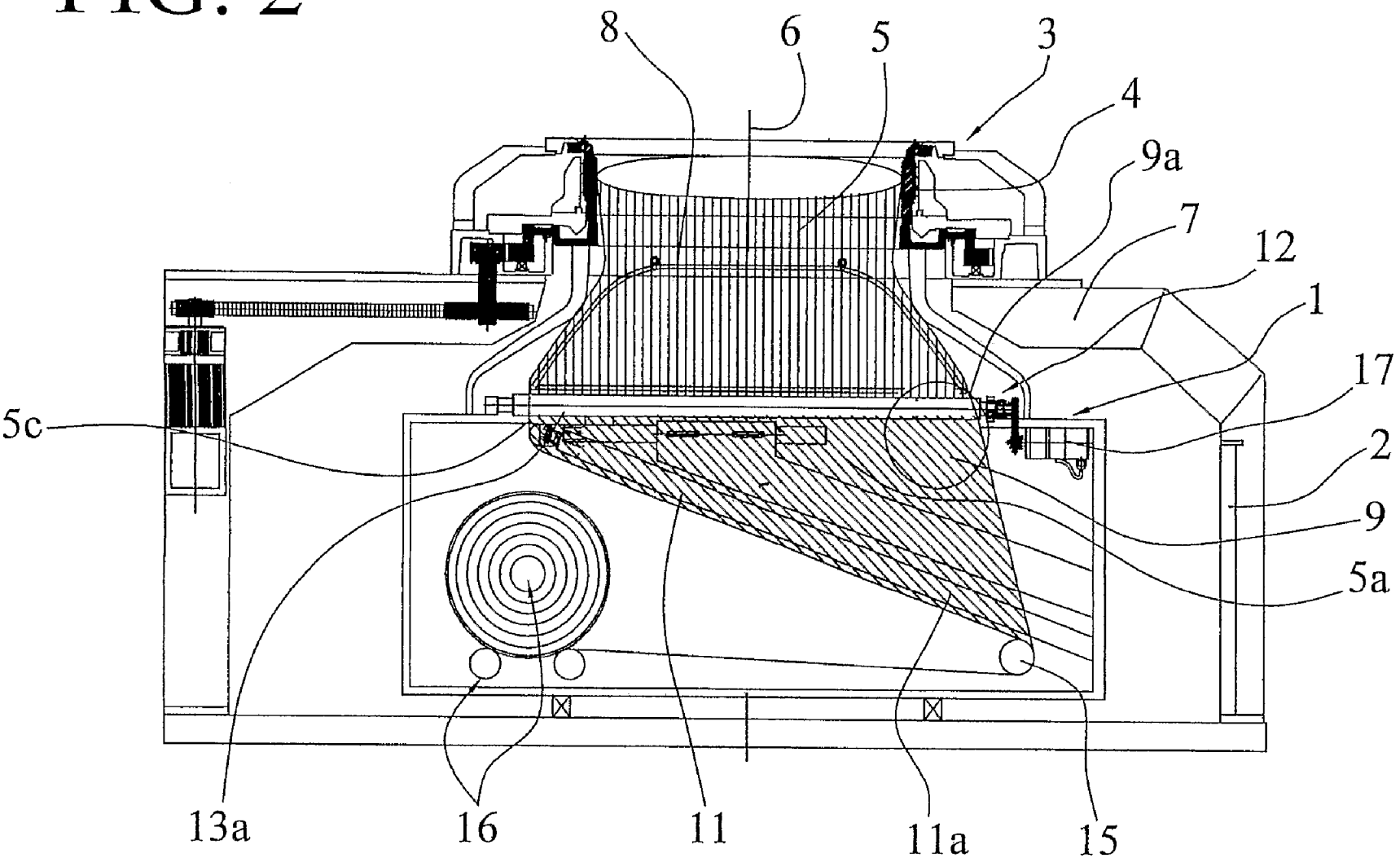
FIG. 2 is a second view in lateral elevation of the device according to a plane perpendicular to the one of FIG. 1.

With reference to the Figures mentioned above, a tensioning device for circular knitting machines according to the invention is globally referred to with the numeral 1. It comprises a supporting frame 2 arranged below a known circular knitting machine 3 designed to manufacture, on a cylinder 4, knitted fabric in a tubular piece 5.

In the disclosed embodiment, the supporting frame 2 turns integrally with the cylinder 4 around a vertical middle axis 6 and it is arranged inside a fixed structure 7 supporting both the frame 2 and the circular machine 3.

In an alternative embodiment, the device 1 is equipped with an actuator designed to enable the rotation of the supporting frame 2 at an angular speed different from the rotational speed of the cylinder 4 of the knitting machine 3.

Near the upper portion of the frame 2 there is a device 8 spreading and shaping the piece 5 coming from the cylinder 4. Such spreading and shaping device 8 comprises a frame designed to progressively change the cylindrical shape of the tubular piece 5 during its forward movement, so as to change the section shape from circular to rectangular in a suitable way so as to allow fabric cutting and following stretching. It should be noted that the piece of tubular fabric is never completely flattened so as to prevent the formation of permanent folds that would jeopardize fabric quality.

Below the spreading and shaping device 8 is arranged a cutter 9, associated to the supporting frame 2 and designed to cut progressively the tubular piece 5 on a cutting point 9*a* along a cutting generatrix.

The cutter 9 can comprise a rotary blade controlled by a cutting motor 10 or a fixed cutting element.

Downstream from the cutter 9 there is a conventional opener and stretcher 11 for opening and stretching the cut piece 5 of fabric. According to the invention, the tensioning device 1 comprises a tensioner 12 for tensioning the piece 5 of knitted fabric, arranged upstream from the opener and stretcher 11 designed to tension the piece 5 of fabric so as to enable the correct production of the piece 5 of fabric by the knitting machine 3. Advantageously, the tensioner 12 for tensioning the piece of fabric is arranged near said cutter 9, downstream from said cutter 9 or at least from the cutting point 9*a*.

In the disclosed embodiment, the cutter 9 is mainly arranged under the tensioner 12, but the cutting point 9*a* is above the tensioner 12.

The tensioner 12 comprises at least two first tensioning rollers 13*a*, 13*b* placed side by side and operatively acting upon at least one portion of a first flap 5*a* of the piece of fabric, and at least two second tensioning rollers 14*a*, 14*b* placed side by side and operatively acting upon at least one portion of a second flap 5*b* of the piece 5 of fabric.

By tensioning the two flaps, said tensioning rollers allow to obtain a uniform force in the point where the knitted fabric is formed.

The portion of a first flap 5*a* of the piece 5 comprises at least one first end of the two fabric ends cut by the cutter 9, and the portion of a second flap 5*b* of the piece 5 comprises at least a second end of the two fabric ends cut by the cutter 9.

Advantageously, it can be further provided for a guiding element, not shown in the Figures, designed to accompany the forward movement of an intermediate portion 5*c* of the piece 5 of fabric not engaged by the tensioner 12, facing the cutting point 9*a* and included between the portion of a first flap 5*a* of the piece and the portion of a second flap 5*b* of the piece.

Figure 3:
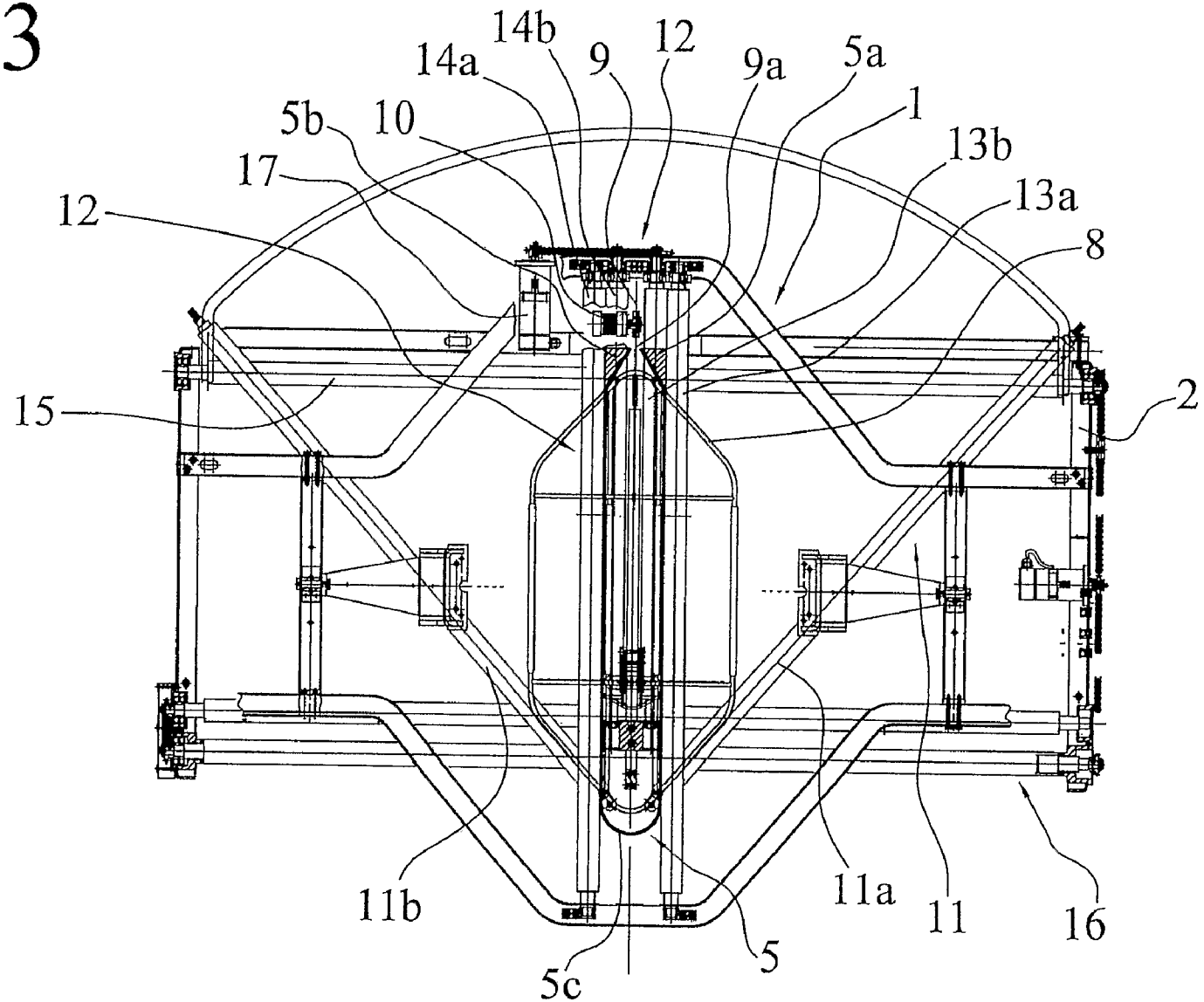
FIG. 3 shows a top view of the device of FIG. 1.

As can be seen in FIG. 3, the inner tensioning rollers 13*b*, 14*b* on the piece 5 of fabric are therefore shorter than the transversal extension of the fabric, since they cannot engage the whole piece 5, which is closed on the intermediate portion 5*c*, whereas the outer rollers 13*a*, 14*a* on the piece 5 can be longer, or as long as the inner rollers 13*b*, 14*b*.

The first tensioning rollers 13*a*, 13*b* are co-planar and parallel to each other and also the second tensioning rollers 14*a*, 14*b* are co-planar and parallel to each other.

Preferably, the first tensioning rollers 13*a*, 13*b* are co-planar to the second tensioning rollers 14*a*, 14*b*, and in the case shown they are also parallel to the latter.

As an alternative, the first tensioning rollers 13*a*, 13*b* can be arranged on an inclined plane with respect to the plane in which the second tensioning rollers 14*a*, 14*b* lie, and preferably in two planes arranged one with respect to the other in a vertical or horizontal "V" shape.

If the cutter does not extend between the first and the second rollers as in the case shown, the first 13*a*, 13*b* and the second tensioning rollers 14*a*, 14*b* can all be placed side by side.

At least one of the first tensioning rollers 13*a*, 13*b* and at least one of the second tensioning rollers 14*a*, 14*b* are actuated by a tensioning motor 17, whereas the remaining rollers can be pulled by the two rollers actuated by the tensioning motor, or all the tensioning rollers can be actuated directly by a tensioning motor 17, which is preferably one for all the tensioning rollers.

The tensioner 12 can be adjustable so as to vary the tensioning force exerted onto the piece 5 of fabric, and it is preferably connected to the control system of the knitting machine 3 so as to enable an automatic adjustment.

In an execution variant not shown in the Figures, the tensioner 12 for the piece 5 of fabric can be arranged upstream from the cutter 9 and from the cutting point 9*a*, on the spreading device 8.

In this case, the tensioner 12 comprises at least two first tensioning rollers 13*a*, 13*b* operatively acting upon at least one portion of a first flap 5*a* of the piece of fabric, which is still tubular, one inside and one outside the piece 5 of fabric, and at least two second tensioning rollers 14*a*, 14*b* operatively acting upon at least one portion of a second flap 5*b* of the piece 5 of fabric, one inside and one outside the piece 5 of fabric.

Preferably, the tensioning rollers 13*a*, 13*b*, 14*a*, 14*b* are gummed so as to increase the friction with the piece 5 of fabric.

In an execution variant, and if there are particular tensioning needs, the device can further comprise an auxiliary tensioner designed to help the forward movement of the piece 5 of fabric and arranged downstream from the opener and stretcher 11, however such auxiliary tensioner is not usually necessary.

Downstream from the tensioner 12 is arranged the opener and stretcher 11 for opening and stretching the cut piece in a single layer of fabric, and a collector 16 for collecting the piece stretched in a single layer by the opener and stretcher 11.

The opener and stretcher 11 comprises two rollers for spreading 11*a*, 11*b* the piece 5 and its side welds obtained by cutting, which rollers are mounted idle onto the frame 2 or preferably actuated by a stretching motor (not shown), and a return roller 15 for the stretched piece, which can also be provided with a motor. The spreading rollers 11*a*, 11*b* can be arranged according to divergent lines inclined downwards and developing starting from mutually side-by-side upper ends arranged in an area of the piece 5 opposed to the cutting point 9*a*, as in Patent EP1155176, or they can be arranged conventionally in a co-planar way.

The collector 16 can comprise, as shown in the Figures, a roller for rolling up the stretched piece in a single layer, actuated by a corresponding collecting motor (not shown), or a lapping device or a basket for collecting the piece stretched in a single layer.

The remaining parts of the machine 3 and of the collecting device 1 have not been described in further detail since they are of conventional type.

The device described above mainly from a structural point of view operates as follows.

The tubular piece 5 coming from the cylinder 4 is gradually shaped to a basically rectangular, partially flattened section by the device 8 for spreading and shaping the piece.

Then the tubular piece 5 is cut by the cutter 9 along a generatrix thereof on the cutting point 9*a*, whereas on the opposite generatrix a guide slides, such as a rotary element preventing flattening and fold formation. The two flaps 5*a*, 5*b* of the cut piece are then tensioned by the first 13*a*, 13*b* and by the second 14*a*, 14*b* tensioning rollers, respectively, which engage as much as possible of the piece 5, so as to obtain a traction that is as uniform as possible, leaving the intermediate portion 5*c* free, which is partially tensioned by the outer rollers only and which is arranged on the generatrix opposed to the cutting line 9*a*.

The cut piece 5 is then progressively spread and stretched by the spreading rollers 11*a*, 11*b*, until it is shifted, now completely opened, onto the return roller 15.

From the latter the piece 5 of fabric in a single layer gets to the collector 16 for collecting in rolls or, if desired, in overlapping laps, possibly by getting through other transmission rollers. The invention achieves important advantages.

First of all, the tensioning device for circular knitting machines according to the invention enables to obviate the typical drawbacks of known tensioning systems, ensuring a very accurate and time-constant tensioning of the fabric being manufactured. This allows, among other things, to obtain a fabric of excellent and constant quality. Moreover, the device enables to obtain a very reliable fabric tensioning even when the device turns at a different angular speed from the cylinder, preventing any fabric twisting. The tensioning device for circular knitting machines according to the invention enables to highly reduce overall sizes, thanks to a very rational and compact tensioning arrangement. Finally, it should be pointed out that the invention is low-cost and of easy implementation.

The invention claimed is:

1. A tensioning device for circular knitting machines comprising:

a supporting frame (2) to be mounted turnably below a circular knitting machine (3), a cutter (9) associated to said supporting frame (2) and designed to cut on a cutting point (9*a*) a knitted fabric in tubular piece (5) produced by the circular knitting machine (3), an opener and stretcher (11) for opening and stretching the cut piece (5) in a single fabric layer, a collector (16) for collecting the piece (5) stretched in a single layer by said opener and stretcher (11), and a tensioner (12) for said piece (5) of knitted fabric, designed to tension the piece (5) of fabric so as to enable the correct production of the piece (5) of fabric by the knitting machine (3), said tensioner (12) for the piece (5) of fabric being arranged upstream from said opener and stretcher (11), characterized in that said tensioner (12) comprises at least two first tensioning rollers (13*a*, 13*b*) placed side by side for operatively acting upon at least one portion of a first flap (5*a*) of said piece (5) of fabric and at least two second tensioning rollers (14*a*, 14*b*) placed side by side for operatively acting upon at least one portion of a second flap (5*b*) of said piece (5) of fabric.

2. The device according to claim 1, characterized in that said tensioner (12) for the piece (5) of fabric is arranged near said cutter (9).

3. The device according to claim 1, characterized in that said tensioner (12) for the piece (5) of fabric is arranged downstream from the cutting point (9*a*) of said cutter (9).

4. The device according to claim 1, characterized in that said first tensioning rollers (13*a*, 13*b*) are placed side by side for operatively acting upon at least one first end of the two fabric ends cut by said cutter (9), and in that said two second tensioning rollers (14*a*, 14*b*) are placed side by side for operatively acting upon at least one second end of the two fabric ends cut by said cutter (9).

5. The device according to claim 4, characterized in that it comprises a guiding element designed to accompany the forward movement of an intermediate portion (5*c*) of said piece (5) of fabric free of said tensioner (12), opposed to the cutting point (9*a*) and included between said portion of a first flap (5*a*) of the piece (5) and said portion of a second flap (5*b*) of the piece (5).

6. The device according to claim 3, characterized in that said first tensioning rollers (13*a*, 13*b*) are co-planar and parallel to each other, and in that also said second tensioning rollers (14*a*, 14*b*) are co-planar and parallel to each other.

7. The device according to claim 4, characterized in that said first tensioning rollers (13*a*, 13*b*) are co-planar to said second tensioning rollers (14*a*, 14*b*).

8. The device according to claim 4, characterized in that said first tensioning rollers (13*a*, 13*b*) are parallel to said second tensioning rollers (14*a*, 14*b*).

9. The device according to claim 4, characterized in that said first tensioning rollers (13*a*, 13*b*) are arranged on an inclined plane with respect to the plane in which said second tensioning rollers (14*a*, 14*b*) lie.

10. The device according to claim 9, characterized in that said first tensioning rollers (13*a*, 13*b*) and said second tensioning rollers (14*a*, 14*b*) are arranged one with respect to the other in a "V shape.

11. The device according to claim 1, characterized in that said first (13*a*, 13*b*) and said second tensioning rollers (14*a*, 14*b*) are placed side by side.

12. The device according to claim 1, characterized in that at least one of said first tensioning rollers (13*a*, 13*b*) and at least one of said tensioning rollers (14*a*, 14*b*) are actuated by a tensioning motor (17).

13. The device according to claim 12, characterized in that said first (13*a*, 13*b*) and said second tensioning rollers (14*a*, 14*b*) are actuated by a tensioning motor (17).

14. The device according to claim 13, characterized in that said first (13*a*, 13*b*) and said second tensioning rollers (14*a*, 14*b*) are actuated by one common tensioning motor (17).

15. The device according to claim 1, characterized in that said tensioner (12) is adjustable so as to vary the tensioning force exerted onto said piece (5) of fabric.

16. The device according to claim 1, characterized in that it further comprises a device (8) for spreading and shaping the tubular piece (5) coming from the circular machine (3), mounted onto said supporting frame (2) and arranged upstream from said cutter (9).

17. The device according to claim 16, characterized in that said tensioner (12) for the piece (5) of fabric are arranged upstream from said cutter (9), on said device (8) for spreading and shaping the piece (5).

18. The device according to claim 1, characterized in that said first tensioning rollers (13*a*, 13*b*) are for operatively acting upon at least one portion of a first flap (5*a*) of said piece (5) of fabric, one inside and one outside said piece (5) of fabric, and second tensioning rollers (14*a*, 14*b*) are for operatively acting upon at least one portion of a second flap (5*b*) of said piece (5) of fabric, one inside and one outside said piece (5) of fabric.

19. The device according to claim 1, characterized in that said tensioning rollers (13*a*, 13*b*, 14*a*, 14*b*) are gummed so as to increase the friction with the piece (5) of fabric.

20. The device according to claim 1, characterized in that it further comprises an auxiliary tensioner designed to ease the forward movement of the piece (5) of fabric and arranged downstream from said opener and stretcher (11).

21. The device according to claim 1, characterized in that said collector (16) comprises a basket for collecting the piece (5) stretched in a single layer.

22. The device according to claim 1, characterized in that said collector (16) comprises a roller for rolling up the piece (5) stretched in a single layer, actuated by a corresponding collecting motor.

23. The device according to claim 1, characterized in that it further comprises at least one return roller (15) placed between said opener and stretcher (11) and said collector (16).

24. The device according to claim 1, characterized in that said opener and stretcher (11) the cut piece (5) comprises at least two rollers for spreading (11*a*, 11*b*) the piece (5) and its side welds obtained by cutting, actuated by at least one stretching motor.

25. The device according to claim 1, characterized in that said cutter (9) comprises a rotary blade controlled by a cutting motor (10).

26. The device according to claim 1, characterized in that said cutter (9) comprises a fixed cutting element.

27. The device according to claim 1, characterized in that the device (1) can be fastened integrally with the cylinder (4) of said knitting machine (3) so as to rotate with the cylinder (4).

28. The device according to claim 1, characterized in that the device (1) is equipped with actuating means designed to enable the rotation thereof at a different angular speed from the rotational speed of said cylinder (4) of said knitting machine (3).

29. A circular knitting machine (3), characterized in that is comprises a device (1) according to claim 1.

* * * * *